US007044904B2

(12) United States Patent
Beattey

(10) Patent No.: US 7,044,904 B2
(45) **Date of Patent: *May 16, 2006**

(54) CENTRIFUGE WITH CLUTCH MECHANISM FOR SYNCHRONOUS BLADE AND BOWL ROTATION

(76) Inventor: Jeffery N. Beattey, 8689 Admirals Woods Dr., Indianapolis, IN (US) 46236

( * ) Notice: Subject to any disclaimer, the term of this patent is extended or adjusted under 35 U.S.C. 154(b) by 0 days.

This patent is subject to a terminal disclaimer.

(21) Appl. No.: 10/234,296

(22) Filed: Sep. 3, 2002

(65) Prior Publication Data

US 2003/0013592 A1 Jan. 16, 2003

Related U.S. Application Data

(63) Continuation of application No. 09/090,043, filed on Jun. 3, 1998, now Pat. No. 6,478,724.

(51) Int. Cl.
*B04B 9/00* (2006.01)
*B04B 11/08* (2006.01)

(52) U.S. Cl. ..... 494/55; 494/84

(58) Field of Classification Search ..... 494/42, 494/54, 55, 56, 60, 63, 65, 84; 210/374
See application file for complete search history.

(56) References Cited

U.S. PATENT DOCUMENTS 2,040,351 A * 5/1936 Williams
2,056,888 A * 10/1936 Pecker
2,113,160 A 4/1938 Murphree et al.
2,414,421 A * 1/1947 Small
2,443,593 A 6/1948 Birsch
3,228,595 A 1/1966 Sharples
3,307,666 A * 3/1967 Miller et al.
3,403,848 A 10/1968 Windsor et al.
3,687,360 A 8/1972 Prew et al.
3,741,465 A 6/1973 Lincoln
3,771,290 A 11/1973 Stethem
3,773,253 A * 11/1973 Laven
3,851,819 A * 12/1974 Tadokoro
3,861,584 A 1/1975 Dudrey
3,937,317 A 2/1976 Fleury, Jr.

(Continued)

FOREIGN PATENT DOCUMENTS

DE 39-27707 A1 3/1990

(Continued)

*Primary Examiner*—Charles E. Cooley
(74) *Attorney, Agent, or Firm*—C. Richard Martin, Esq

(57) ABSTRACT

An improved centrifuge apparatus comprising a spindle with an affixed bowl and a drive shaft passing through the spindle with a plurality of scraper blades affixed which rotate within the bowl. The spindle is driven by a pulley with a belt attached to a motor. The centrifuge has a clutch mechanism which provides a positive lock to insure synchronous blade and bowl rotation during processing. The clutch mechanism comprises a shifting coupling attached to the drive shaft with a bottom set of teeth and a top set of teeth. The bottom set of teeth interlockingly engage a matching set of teeth located on either the pulley or the top of the spindle. The top set of teeth interlockingly engage a matching set of teeth that are either immovably attached to a plate or attached to a sprocket which is rotatably attached to the plate. The scraper blades have recesses in their front face to allow a variable cutting edge geometry and the mixing and matching of cutting edge geometry while permitting the use of the same base blade. The centrifuge has a tangential outlet and an annular housing to minimize spray and misting in the exiting centrifuged liquid.

17 Claims, 16 Drawing Sheets

U.S. PATENT DOCUMENTS 4,141,835 A 2/1979 Schael et al.
4,155,503 A 5/1979 Sears
4,223,829 A 9/1980 Bange
4,234,123 A 11/1980 Cory
4,416,655 A * 11/1983 Bennett
4,432,747 A 2/1984 Posse et al.
4,447,322 A 5/1984 Zajdlik
4,449,967 A 5/1984 Caldwell
4,522,620 A * 6/1985 Leister
4,585,558 A 4/1986 Rubin
4,978,331 A 12/1990 Luchetta et al.
4,990,130 A 2/1991 Prais
5,250,180 A 10/1993 Chang
5,356,367 A * 10/1994 Carr
5,362,293 A 11/1994 Romanauskas
5,368,541 A 11/1994 Knelson
5,380,434 A 1/1995 Paschedag
5,425,698 A * 6/1995 Carr
5,454,777 A 10/1995 Ziems et al.
5,466,385 A * 11/1995 Rogers et al.
5,529,566 A 6/1996 Weil
5,681,257 A 10/1997 Letourneur
5,709,643 A 1/1998 Borgstrom et al.
5,714,858 A 2/1998 Pieralisi
5,733,238 A * 3/1998 Carr
5,743,840 A * 4/1998 Carr
5,765,671 A * 6/1998 Endo et al.
5,879,279 A 3/1999 Berger et al.
6,126,587 A * 10/2000 Berger et al.
6,149,573 A * 11/2000 Berger et al.
6,224,532 B1 * 5/2001 Beattey
6,461,286 B1 * 10/2002 Beattey ..... 494/8
6,776,752 B1 * 8/2004 Carr ..... 494/55
6,932,757 B1 * 8/2005 Beattey ..... 494/55
2005/0043164 A1 * 2/2005 Opfer ..... 494/55

FOREIGN PATENT DOCUMENTS

JP 59-066367 4/1984
JP 59-225761 * 12/1984
JP 59225761 A 12/1984

* cited by examiner

CENTRIFUGE WITH CLUTCH MECHANISM FOR SYNCHRONOUS BLADE AND BOWL ROTATION

This application is a continuation of application Ser. No. 09/090,043 filed on Jun. 3, 1998 which issued as U.S. Pat. No. 6,478,724 on Nov. 12, 2002.

BACKGROUND OF THE INVENTION

The present invention relates to a centrifugal separation device and method of separating solids in liquids. The liquid has solid particles in suspension. Suspended solids removal can be achieved in many ways. Solids can be settled out in a tank, filtered out using cartridges or indexing paper or a filter press. Settling is a slow process and other alternatives generate an immense labor cost or a waste stream that may be greater than the solids alone.

Use of a centrifugal separation device allows the extraction of the solid particles from the liquid. In a centrifugal separator, the separation of the solid from the liquid is commonly accomplished by pumping the contaminated liquid or coolant into a high speed rotating chamber or bowl. The centrifugal forces created by high speed rotation of the chamber cause the contaminated fluid to conform to the interior surface of the rotating chamber. The centrifugal energy causes the heavier solids to concentrate in a solid cake form for easy removal, reclamation, reuse or disposal. Since the chamber or bowl is rotating at a high speed, the solid material adheres to the side of the bowl while a cleansed coolant or liquid exits through an opening or openings commonly located at the bottom or top of the bowl. Centrifugal separation is preferable to the more traditional medium of filtration because filtration does not allow for removal of submicron particles without extensive and very expensive filtering. When such filtering is performed, the filter paper or cartridges become clogged quickly and must be disposed of. Additionally, these filtration devices often cannot pass high viscosity fluid.

With the advent of computer controls, the horizon of activities to which centrifugal separation may be applied, such as use as a waste separator, has been greatly expanded. For example, metal working coolants often become contaminated during grinding, wire drawing, machining, polishing, vibratory deburring or other metal working processes. Centrifugal separation allows fluid cleaning to increase coolant life and the solid discharge from centrifugation may have a marketable value or be disposable at minimal costs. The large spectrum of applications extends to contaminated fluids resulting from phosphate baths, dielectrics, glass grinding, EDM machining, water rinse baths, acid baths, all the way to food processing wherein oils can be contaminated by starches and other food products.

It is well known in the art that the efficiency of a centrifugal separator decreases when the scraper blades or stilling vanes do not rotate at the same speed as the bowl or chamber. It is desirable if the scraper blades inside the bowl rotate at the same speed as the bowl until such time as it is desired for them to scrape or plow the solids from the side of the bowl and expel them from the process chamber.

Current systems, as will be discussed in more detail later, use a frictional mechanism in an attempt to obtain equal rotational speeds between the blades and the bowl. This frictional mechanism does not provide the consistent synchronous blade and bowl rotation desired. In operation, a user will start the system up and direct a strobe light into the centrifuge to check whether the bowl and blade are rotating at the same speed. Since the frictional mechanism does not provide a positive lock between the bowl and the blade there is no way of knowing whether the bowl and blade are continuing to rotate together during processing. Furthermore, the frictional clutch mechanism possesses a great many parts, which increases the amount of time that must be spent for maintenance purposes.

Additionally, current systems are prone to spray or mist the fluids exiting the rotating bowl, which can be hazardous to human occupants in the room where centrifugation is occurring. Also, this spray or mist can collect and cause dripping which coats the centrifuge or surrounding machinery, and may contaminate the solids expelled from the centrifuge into a waiting receptacle.

Another difficulty encountered is that some sticky solids refuse to let go of the blade during scraping. Different geometries are preferable to get the solid to peel off. However, each blade must be balanced to reduce vibration of the system, and it is expensive to produce and balance each blade properly. It would be advantageous if individual blades could be customized with different geometries for use in different applications.

The present invention meets the demand for a coupling mechanism ensuring synchronous blade and bowl rotation in the centrifuge. Additionally, it minimizes the occurrence of spray and misting upon exit from the apparatus. Furthermore, it provides a solution to the problem of obtaining variable geometries using a standard blade with inserts.

SUMMARY OF THE INVENTION

In one aspect of the invention the centrifuges comprises a spindle centered on a longitudinal axis with a top portion, a bottom portion, and a hollow interior extending along the longitudinal axis, a bowl attached to the bottom portion of the spindle and a drive shaft passing through the hollow interior with a plurality of scraper blades attached to the drive shaft. The centrifuge has a clutch mechanism comprising a shifting coupling attached to the blade drive shaft via a key locked in a rotary direction. The shifting coupling has a first set of teeth that interlockingly engage a second set of teeth. The second set of teeth are attached to the top of the spindle in one embodiment. In another embodiment the second set of teeth are attached to a pulley attached to the top portion of the spindle. The shifting coupling may be shifted upward and downward along the longitudinal axis between two positions. In the first position the first and second set of teeth are lockingly engaged so that the spindle and the scraper drive shaft rotate together. In the second position the first and second sets of teeth are disengaged.

In another aspect of this invention the centrifuge comprises a spindle configured to rotate about an axis. A bowl is attached to and rotates with the spindle. A drive shaft is received within a passageway of the spindle and rotates about the same axis. A scraper blade is attached to and rotates with the drive shaft. A mechanism is provided to selectively couple the drive shaft and spindle together to allow both to be driven by the same motor.

In another aspect of this invention the centrifuge scraping apparatus comprises blades with recesses on its front face adjacent the end of the blade next to the inner surface of the bowl. Inserts are placed in the recesses to give the scraper blade different cutting surfaces for contacting solids accumulated on the interior wall of the bowl.

In another aspect of the invention the centrifuge scraping kit comprises a rotatable scraper frame with a number of opposing ends. Each of the ends is adjacent the interior wall of the bowl and is also adjacent a front face of a blade in which a number of recesses are defined. A set of scraper inserts configured to plow solids accumulated on the interior wall of the bowl are placed in the recesses.

In another aspect of the invention the centrifuge comprises a housing with a rotatable bowl therein. The housing is cylindrical with a closed top end and an at least partially open bottom end. The housing has a tangential outlet which minimizes the entrainment of gas by a liquid exiting the bowl during processing.

In another aspect of the invention the centrifuge comprises a spindle attached to a bowl which rotate together. The centrifuge has a drive shaft which is received in a passageway defined by the spindle. The drive shaft is attached to scraper blades which rotate with the drive shaft. The centrifuge has means for selectively rotating the drive shaft and spindle together.

DESCRIPTION OF THE PREFERRED EMBODIMENT

Figure 1:
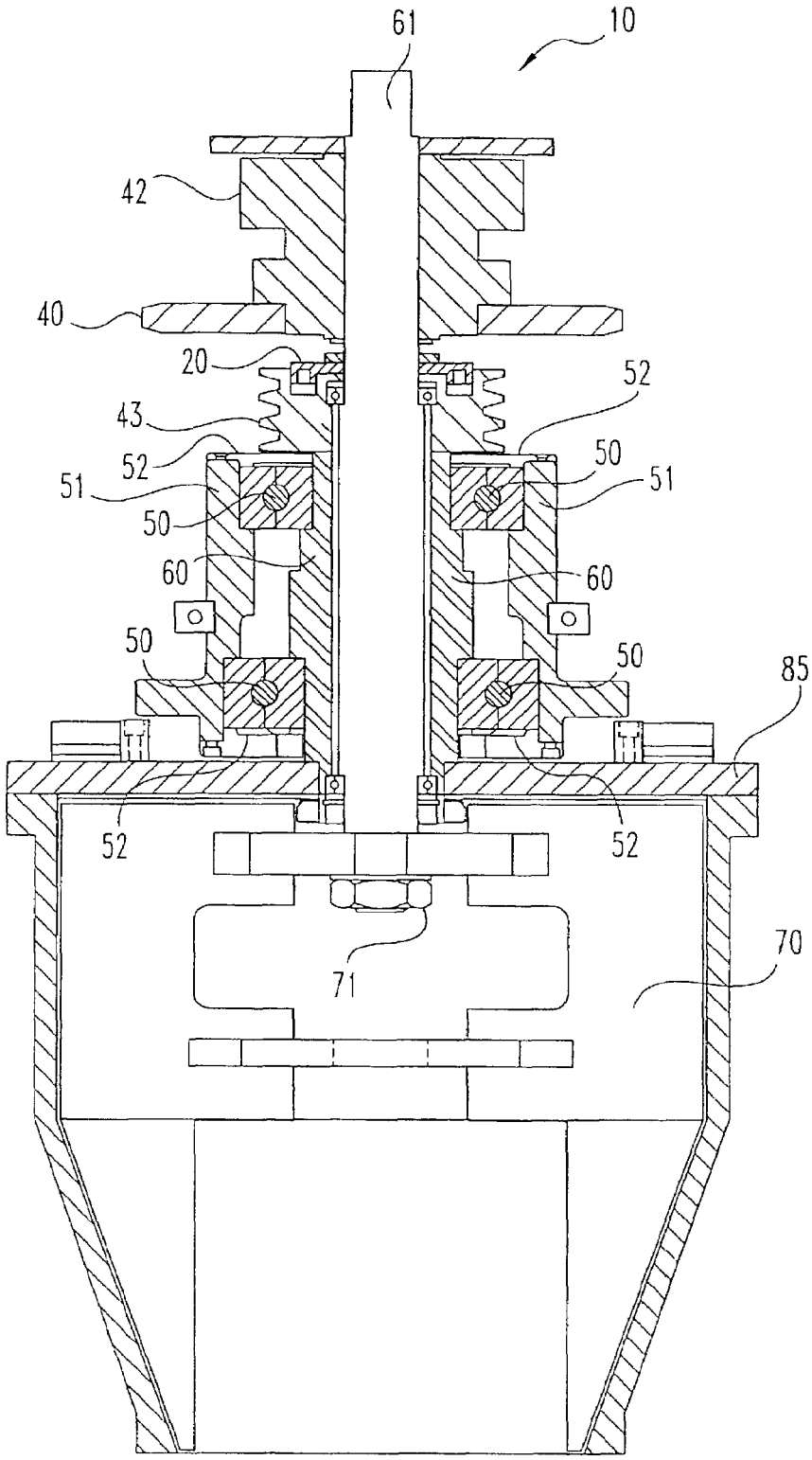
Fig. 1 (PRIOR ART)
FIG. 1 is a partial cross-sectional side view of a centrifuge assembly of the prior art with a frictional clutch mechanism.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated device, and any further applications of the principles of the invention as illustrated therein being contemplated as would normally occur to one skilled in the art to which the invention relates.

Figure 2:
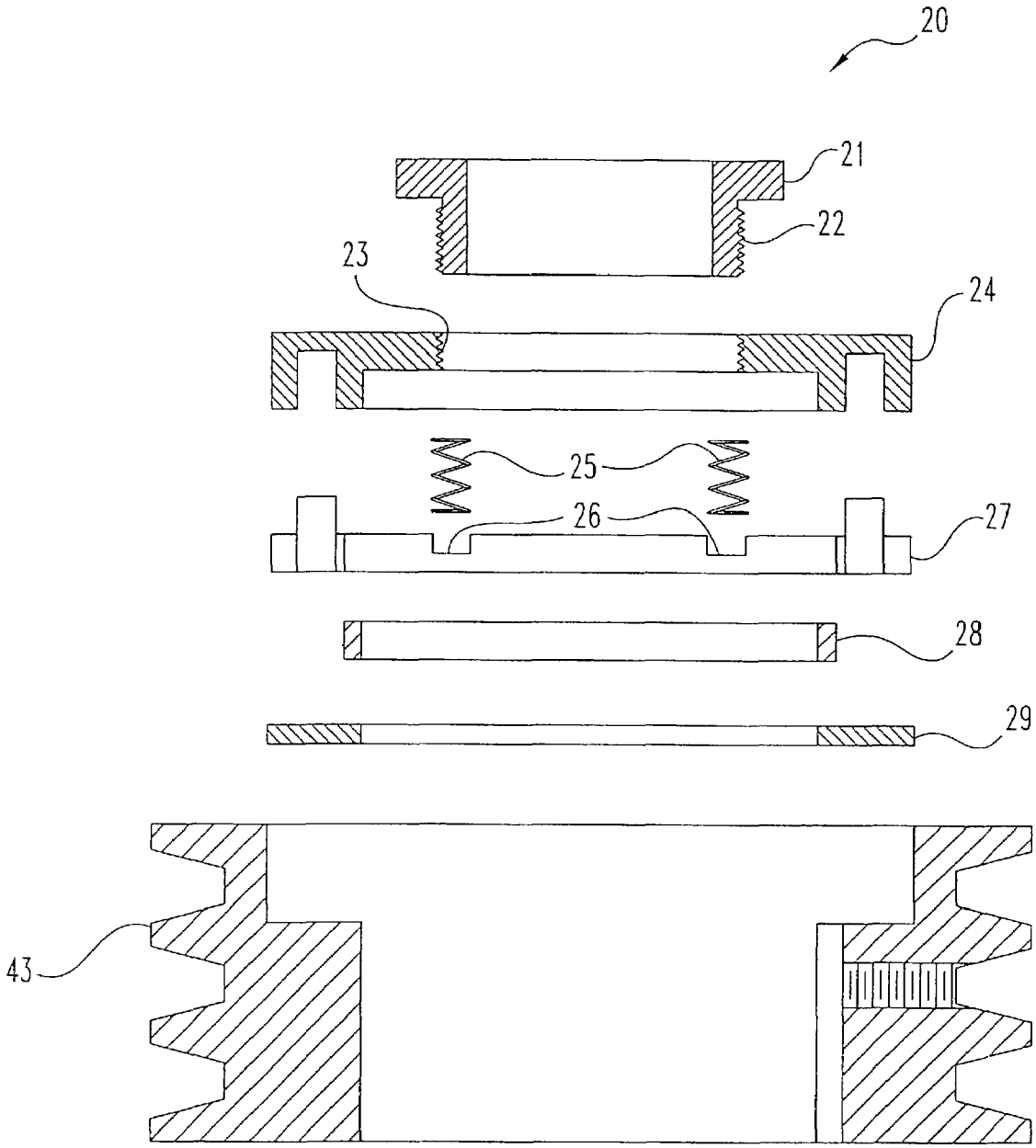
Fig. 2 (PRIOR ART)
FIG. 2 is an exploded, partial cross-sectional side view of the frictional clutch assembly which comprises a part of the FIG. 1 prior art centrifuge assembly.

In order to more fully illustrate the advantages of the present invention, the device of the prior art will be described. With reference to FIGS. 1 and 2, a prior art centrifugal separator with a frictional mechanism to ensure synchronous bowl and blade rotation is illustrated. A portion of the prior art assembly 10 is shown in FIG. 1 with more detail of the frictional clutch assembly 20 shown in FIG. 2.

The assembly 10 comprises a spindle 60 with a lower and upper end. Bowl 85 is fixedly attached to the lower end of spindle 60 and pulley 43 is affixed to the upper end of spindle 60. A scraper blade or stilling vane shaft 61 has an upper portion fixedly attached to a sprocket 40 and a lower portion affixed to a plurality of blades 70 by a nut 71 which holds blades 70 on shaft 61. Spindle 60 and shaft 61 are concentric and spindle 60 defines an internal passage through which shaft 61 is received. The centrifuge has main bearings 50, and bearing caps 52 located within bearing housing 51.

During processing, pulley 43 is driven by a belt (not shown) attached to a first motor (not shown) which provides motive force for turning spindle 60 and fixedly attached bowl 85 as well as shaft 61 and blades 70 through frictional clutch assembly 20. During the scraping mode motive force for the rotation of the shaft 61 and affixed blades 70 is accomplished by a chain (not shown) attached around sprocket 40 which is powered by a second motor (not shown). In the scraping mode only the sprocket 40 is being driven. The sprocket 40 is free floating until actuated by pneumatic clutch 42 which forces sprocket 40 to engage frictional clutch assembly 20.

Frictional clutch assembly 20 consists of an adjusting nut 21 with external threading 22. External threading 22 matches the internal threading 23 in adjusting plate 24. Adjusting plate 24 sits on four springs 25 spaced evenly around the circumference of pressure plate 27. The springs 25 are received in slots 26 defined by pressure plate 27. Pressure plate 27 rests on top of a bronze bushing 28. Bronze bushing 28 sits on friction disc 29 which sits on pulley 43. The friction disc 29 resists differences in rotational speed and is intended to ensure synchronous bowl 85 and blade 70 rotation.

The difficulties associated with use of the frictional clutch assembly 20 are numerous. For one, it has numerous parts subject to wear and replacement. Additionally, friction disc 29 does not provide a positive lock to ensure synchronous bowl and blade rotation, but, instead, the system must be constantly monitored to ensure bowl and blade rotation are occurring at the same rotational speeds. In operation, whenever the centrifuge is in scraping mode the user is causing it to overcome friction forces causing wear to frictional clutch assembly 20. Furthermore, as friction disc 29 wears, the difference in rotational speeds and the difficulty in obtaining synchronous blade and bowl rotation is increased.

With reference to FIGS. 3–6, an embodiment of the clutch mechanism for providing synchronous bowl and blade rotation of the present invention is illustrated. The centrifuge apparatus has a spindle 160 and scraper blade or stilling vane drive shaft 161. Spindle 160 has a hollow interior defining a passageway extending along the longitudinal axis L around which spindle 160 and shaft 161 rotate. Shaft 161 is concentric with spindle 160 and passes through the passageway defined by the hollow interior of spindle 160. The spindle 160 is journalled on main bearings 150 which are received in bearing caps 152 within bearing housing 151. The shaft 161 is journalled on scraper bearings 153 which are held in place by bearing retainer rings 153*a*. Bowl 185 is held on spindle 160 by retainer ring 154 and nut 155. Seals 156 and 156*a* aid in preventing fluid from escaping centrifuge bowl 185 and contacting bearings 153 or 150. In one embodiment, centrifuge bowl 185 has an inverted cup shape and the centrifuge is an inverted bowl automatic self-discharging centrifuge. It is understood, however, that other types of centrifuges, including those with openings for exiting liquids at the top instead of the bottom of the bowl, are contemplated as within the scope of the invention.

Spindle 160 has a top portion to which pulley 143 is fixedly attached and a bottom portion to which bowl 185 is affixed. More specifically, the bottom portion of spindle 160 is affixed to bowl lid 186. Motive force for rotating spindle 160 and bowl 185 is provided by a belt 208 on pulley 143 (See FIGS. 5 and 6) which in turn is driven by motor 207. It is understood that throughout the entirety of this invention that alternative drive mechanisms such as a sprocket and chain combination may be used interchangeably with the pulley and belt combination.

Shaft 161 is affixed to blades 170 at the bottom end of shaft 161. It is understood that the centrifuge may possess two or more blades. The blades 170 are held by a nut 171 on shaft 161. The shaft 161 has threading upon which nut 171 is screwed and possesses further threading below nut 171 upon which impeller or accelerator 172 is screwed. The impeller 172 may have a nut welded on it, so that in an alternative embodiment blades 170 are held on shaft 161 by impeller or accelerator 172 alone. Centrifuge bowl 185 has an exterior surface 179 and an interior surface 180. Centrifuge bowl 185 at the top portion has a lid 186 with external surface 181 and internal surface 182. Gaskets or O-rings 183 are provided to prevent leakage of liquid from the lid 186 of bowl 185.

Figure 3:
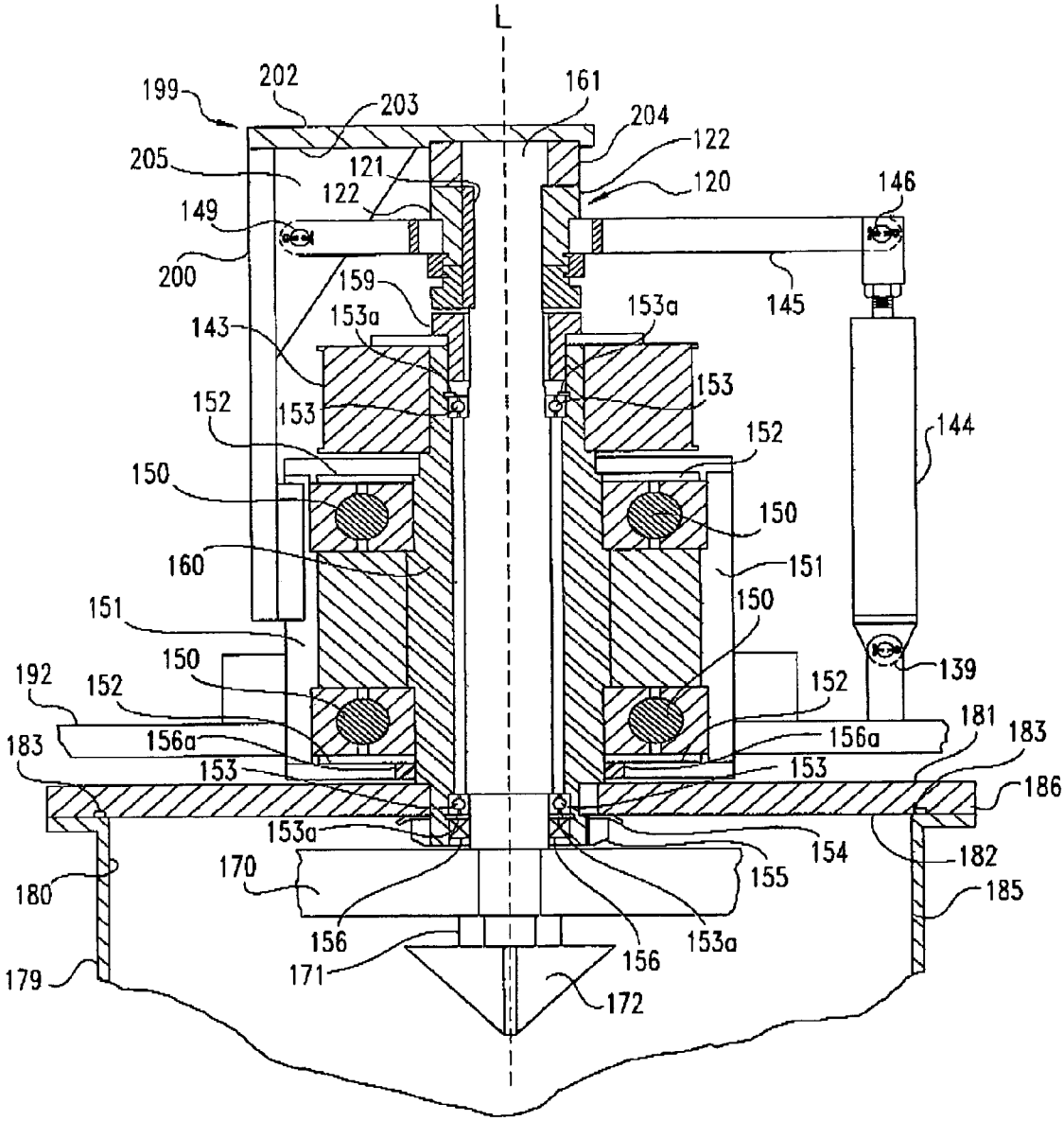
FIG. 3 is a partial cross-sectional fragmentary view of the clutch mechanism and drive assembly according to a typical embodiment of the present invention.
Figure 4:
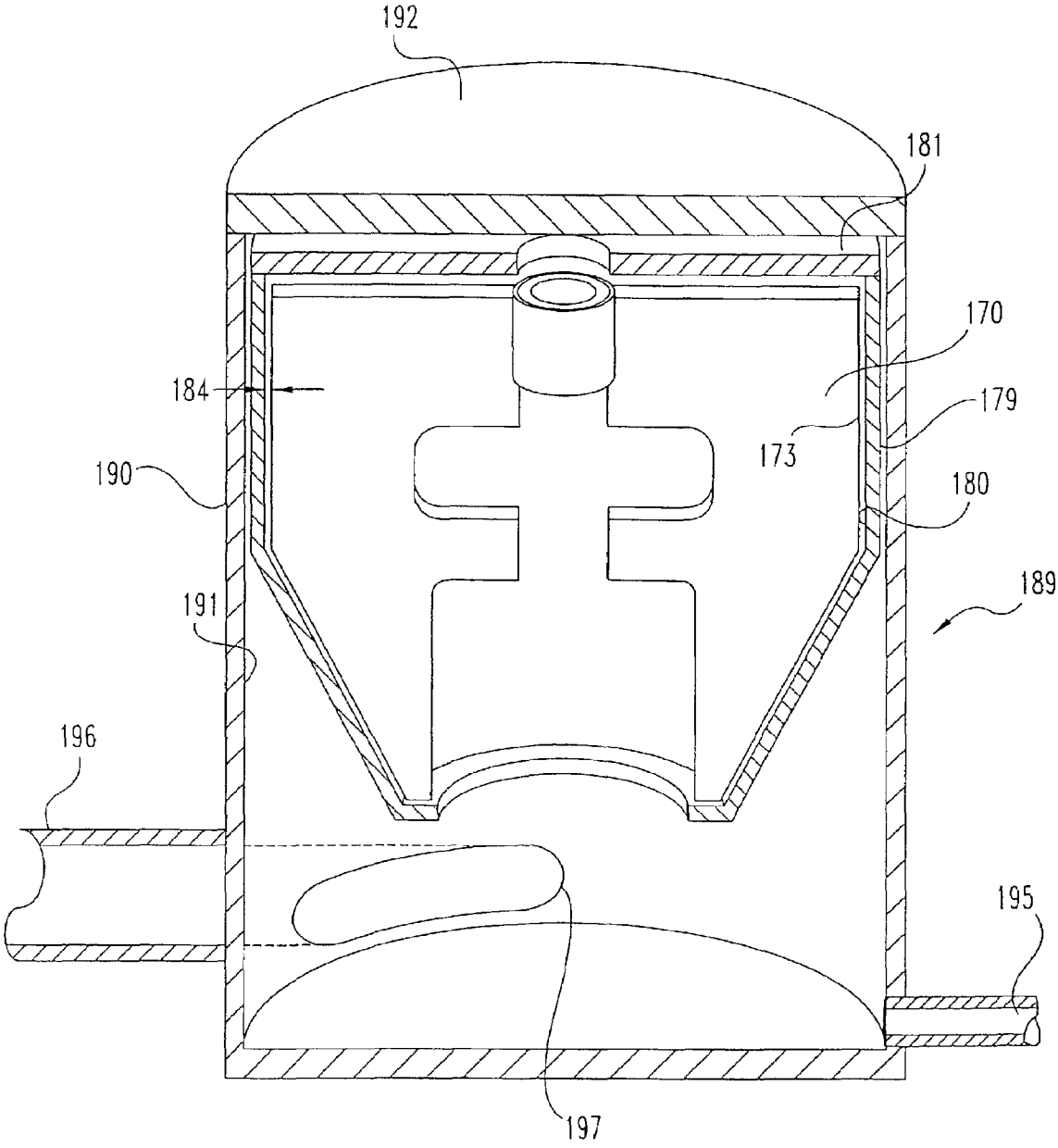
FIG. 4 is a perspective view of the housing with bowl and blades of the present invention.
Figure 5:
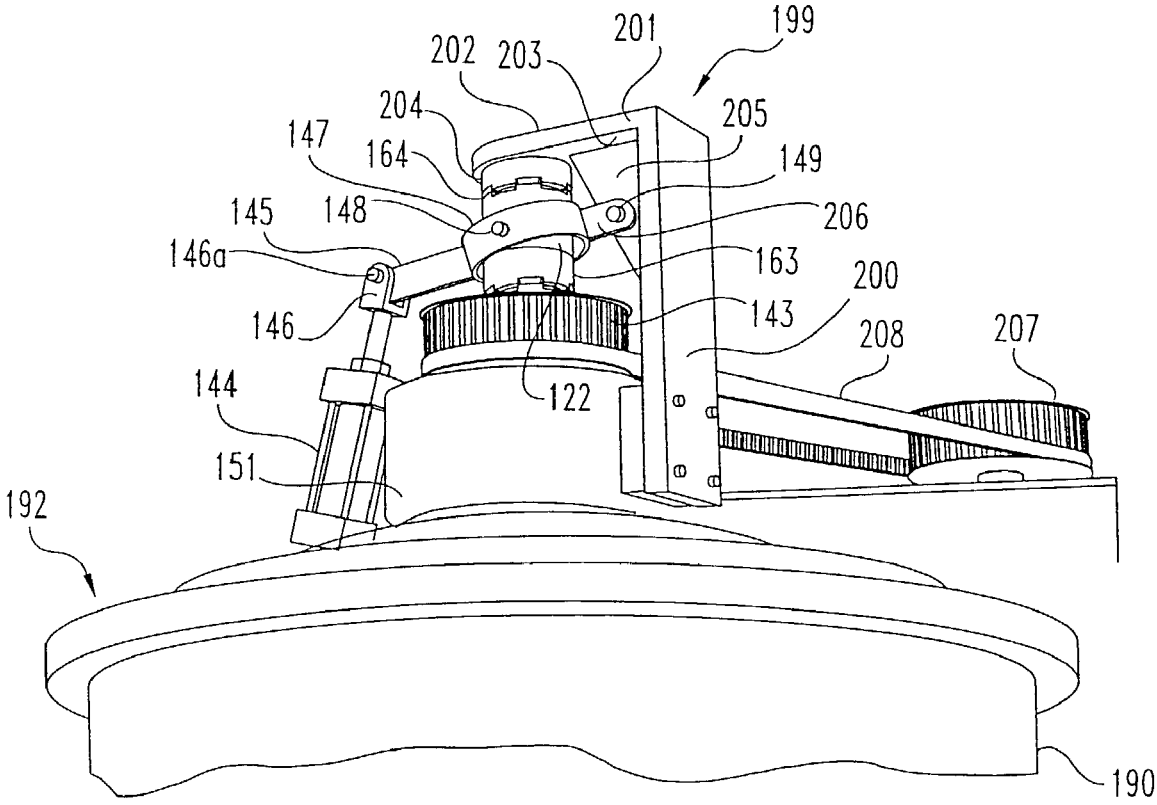
FIG. 5 is a perspective side view of the clutch mechanism and drive assembly according to a typical embodiment of the present invention.
Figure 6:
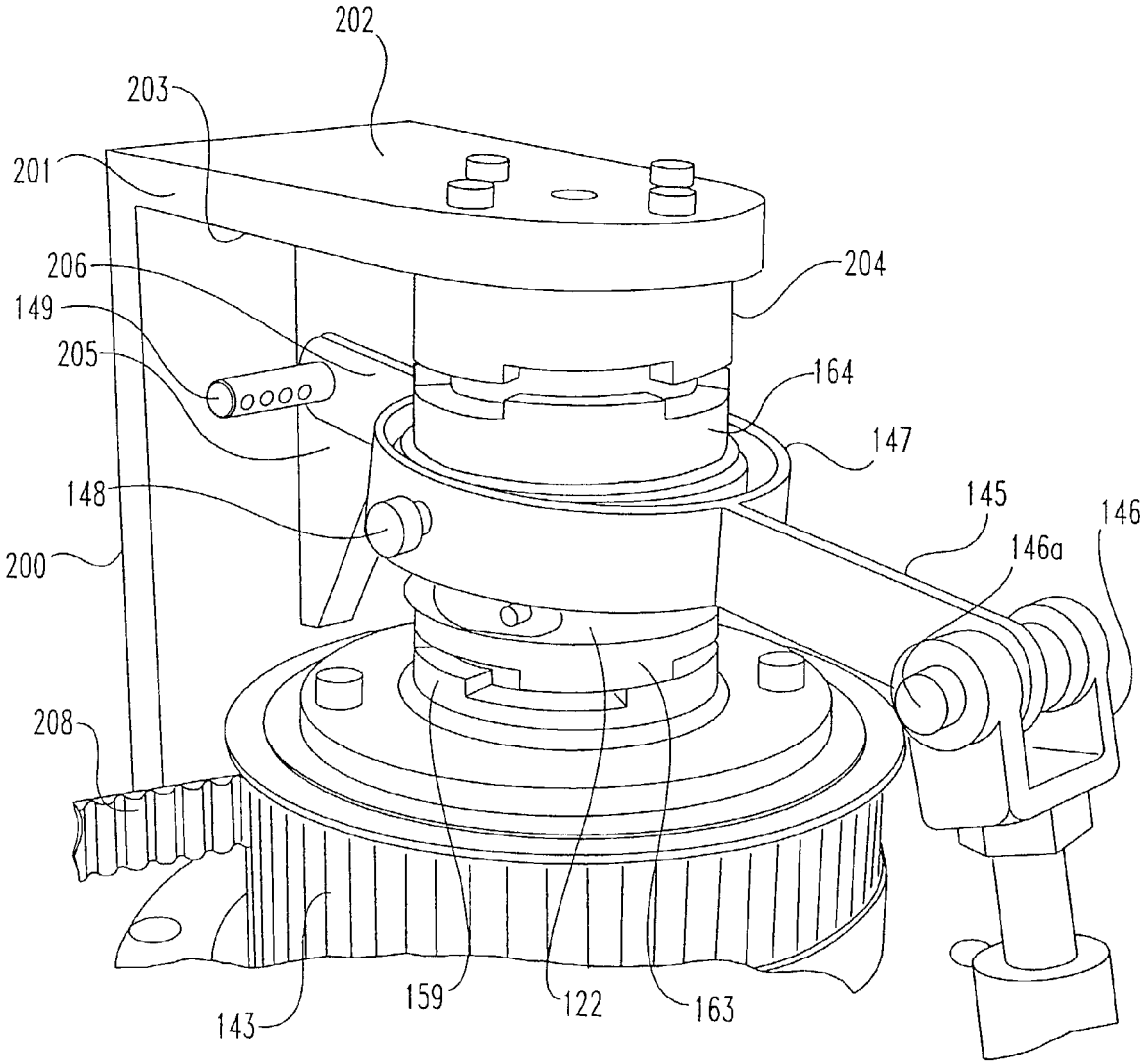
FIG. 6 is another perspective side view of the clutch mechanism and drive assembly according to the same embodiment of the present invention.

With reference to FIGS. 3 and 4, centrifuge bowl 185 and blades 170 rotate within a housing 189 with a top 192 and a cylindrical portion with exterior surface 190 and interior surface 191. The housing 189 has an inlet tube 195 which provides liquid with solids in suspension to the bottom injector (not shown) which injects it upward into rotating blades 170 and bowl 185. It is understood that alternative injection arrangements, including top injectors wherein liquid is provided through a passageway defined within the interior of drive shaft 161 are within the scope of the invention. An outlet port 196 from a tangential outlet 197 exits the housing 189 to a storage location or a drain for the liquid from which solids have been centrifuged. In some cases, the exiting liquid may be immediately injected back into whatever application it becomes contaminated in.

Each of blades 170 has an edge 173. In one embodiment, the clearance or gap 184 between blade edges 173 and bowl interior surface 180 is on the order of 2 mm. Solids may coat the bowl interior surface 180, thus reducing wear, and fill the gap 184. It is understood that clearance 184 may be greater or lesser than 2 mm.

The clutch assembly 120 is moved upward and downward by a pneumatically driven shifter 144. Shifter 144 is affixed at bottom portion 139 (FIG. 3) to the top of housing 192. In an alternative embodiment, the bottom portion 139 of shifter 144 may be affixed to the exterior surface of bearing housing 151. It is understood that the bottom portion 139 of shifter 144 may be affixed to any convenient nonrotating surface. The top portion 146 of shifter 144 engages a bar 145 which is pivotally connected to shifter 144 by a clevis pin 146*a*. Bar 145 is affixed to mating structure 147 which encircles or otherwise surrounds jaw or shifting coupling 122. Shifting coupling 122 is attached to shaft 161 by a key 121 (FIG. 3). Coupling 122 may possess any geometry which will mate with shaft 161 and not allow it to slip in a rotating fashion. That is, coupling 122 has a geometrical mating surface that does not permit rotational motion relative to shaft 161, but coupling 122 can slide up and down along the longitudinal axis L of shaft 161. While it is preferable that the upward and downward movement of shifting coupling 122 be accomplished with shifter 144, it is understood that bar 145 may be moved manually or by any actuating device such as a ball screw, electric actuator or spring loaded device.

It is contemplated that alternative geometrical mating surfaces for coupling 122 other than a circular profile are within the scope of the invention. It is understood that almost any geometry such as square, pentagonal, hexagonal, etc. may be used. It is further understood that spindle 160 and shaft 161 are also not limited to a circular profile. In a similar manner, mating structure 147 is not limited to a geometry that conforms to or encircles shifting coupling 122 and may be any structure that will allow shifting of shifting coupling 122, including, but not limited to, a fork structure. Mating structure 147 is affixed to shifting coupling 122 by bolts or screws 148. It is understood that alternative fastening mechanisms such as welding, adhesives, and other means known in the art may be used to affix mating structure 147 to shifting coupling 122.

On the opposite side of mating structure 147 from bar 145 is a second bar 206 which is pivotally connected by bolt or screw 149 to plate 205. The triangular plate 205 is part of support structure 199. Support structure 199 has a longitudinally extending portion 200 generally parallel to the longitudinal axis L of spindle 160 and shaft 161. Support structure 199 is L-shaped and further possesses a portion 201 attached to the top of longitudinal portion 200 and extending in a radial direction. Radial portion 201 has a top surface 202 and a bottom surface 203. Triangular portion 205 extends between longitudinal portion 200 and radial portion 201 of support structure 199. It is understood that the support structure may be made out of materials such as metal, ceramics, and composites so long as the material selected possesses sufficient strength to withstand the stresses put on it. It is further understood that support structure 199 may have geometries other than the L-shape described herein.

In one embodiment, support structure 199 is affixed at the bottom portion of longitudinal portion 200 to the exterior surface of bearing housing 151. In an alternative embodiment, support structure 199 is attached to the housing top 192. It is understood that support structure 199 may be attached to any non-rotating portion of the centrifuge in a variety of manners. It is further understood that support structure 199 may also be attached to something other than the centrifuge, such as a plate of another larger outer housing containing the entirety of the centrifuge or even the ceiling of the room in which the centrifuge is located.

Shifting coupling 122 has a set of teeth or other geometrical mating or engagement means 163 on its bottom end facing downward. Additionally, shifting coupling 122 has a set of teeth 164 on its top end facing upward. The set of teeth 163 on shifting coupling 122 facing downward are sized for interlocking engagement with an equal number of teeth 159 facing upward on the top portion of spindle 160. It is understood that set of upward facing teeth 159 may be affixed directly to pulley 143 instead of spindle 160. In a similar manner, set of teeth 164 are sized for interlocking engagement with an equal number of teeth 204 facing downward affixed to the bottom surface 203 of radial portion 201 of support structure 199. In one embodiment, set of teeth 163 and set of teeth 164 are identical. It is contemplated as within the scope of the invention, however, that set of teeth 163 and set of teeth 164 may be of different sizes and possess a different number of teeth or other engagement or interlocking means. In one embodiment, set of teeth 163 and 164 each possess three rectangular shaped teeth formed on the circumference of shifting coupling 122. It is understood that each set of teeth may possess between one to more than twenty teeth. It is further understood that the set of teeth or other engagement or interlocking means may have a profile other than rectangular, including, but not limited to, triangular, trapezoidal, or even an arc of a circle.

It is contemplated as within the scope of the invention that the directions set of teeth 163 and 159, and sets of teeth 164 and 204, respectively, extend toward may be varied so long as the directions used permit interlocking engagement. For example, set of teeth 163 could face radially outward and set of teeth 159 could face radially inward or vice-versa. Additionally, set of teeth 163 could extend along the longitudinal axis and engage set of teeth 159 extending in a radial direction or vice-versa. Additional variations as would occur to a person of ordinary skill in the art are contemplated as within the scope of the invention and may be applied to sets of teeth 164 and 204 as well. These variations may include placing sets of teeth 163, 164 on the sides of shifting coupling 122 instead of the bottom and top surfaces respectively.

Figure 7:
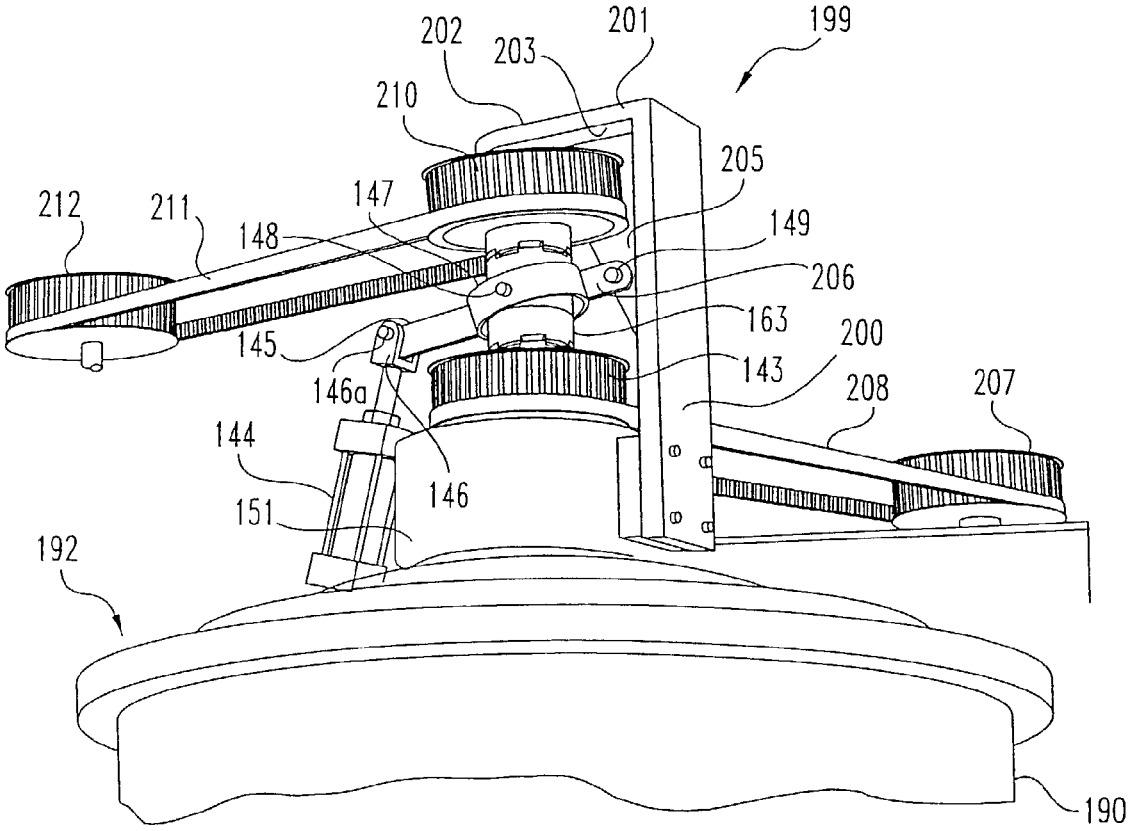
FIG. 7 is a perspective side view of the clutch mechanism and drive assembly according to a second embodiment of the present invention.
Figure 8A:
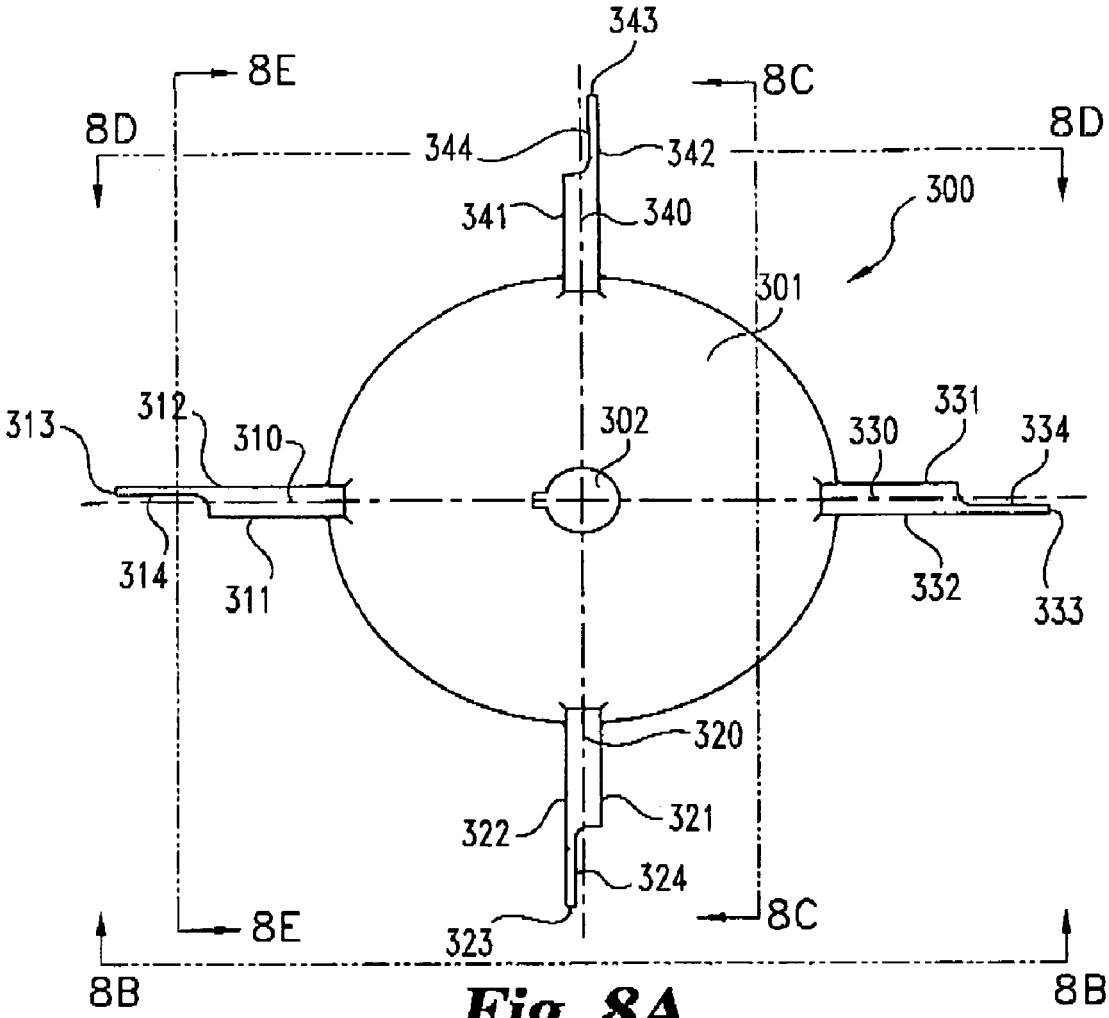
FIG. 8A is a top view of the blade assembly with recesses of the present invention.
Figure 8B:
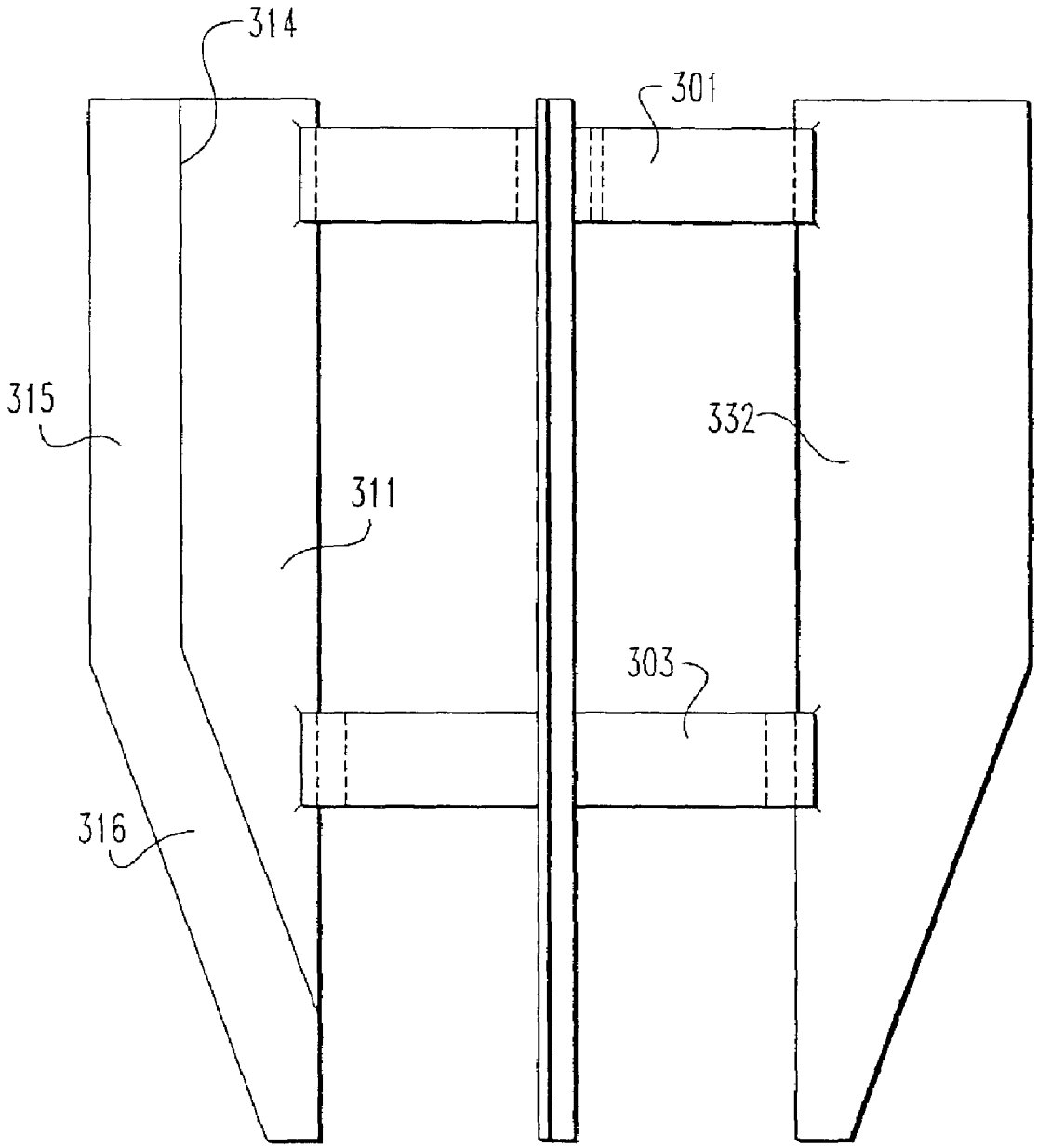
FIG. 8B is a side view of the blade assembly with recesses of the present invention in the 8B—8B {1—1} direction of FIG. 8*a*.
Figure 8C:
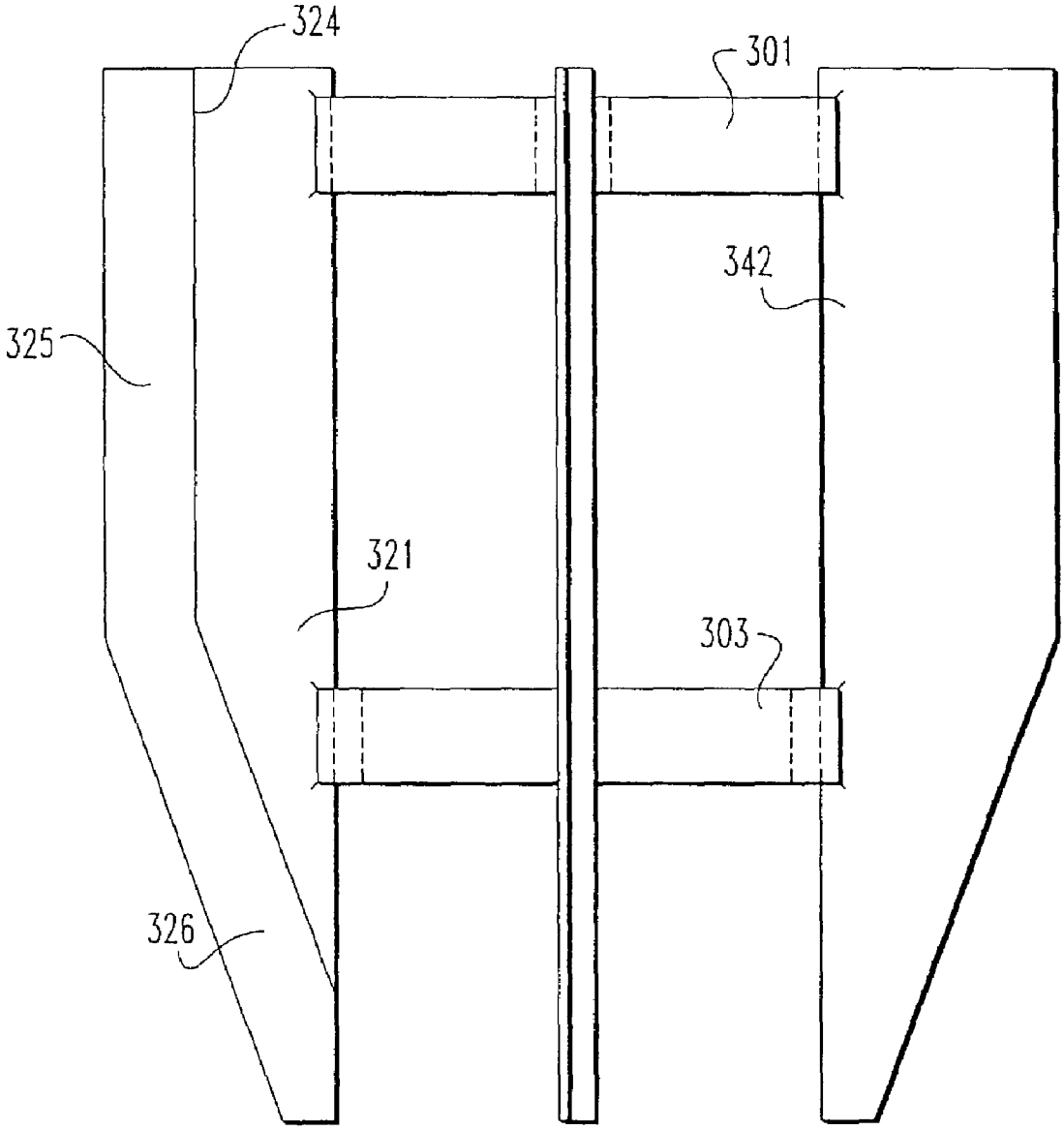
FIG. 8C is a side view of the blade assembly with recesses of the present invention in the 8C—8C {2—2} direction of FIG. 8A.
Figure 8D:
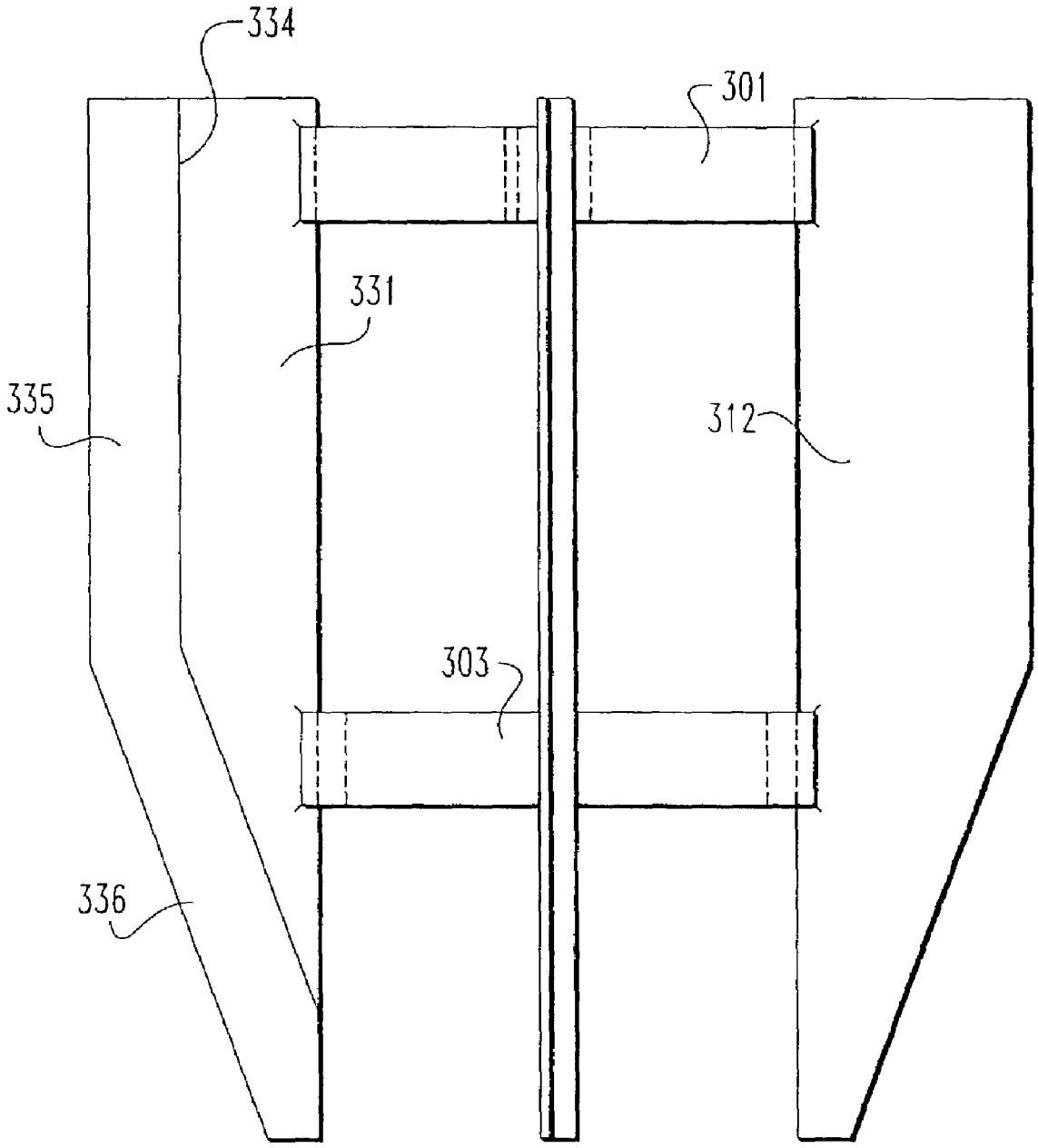
FIG. 8D is a side view of the blade assembly with recesses of the present invention in the 8D—8D {3—3} direction of FIG. 8A.
Figure 8E:
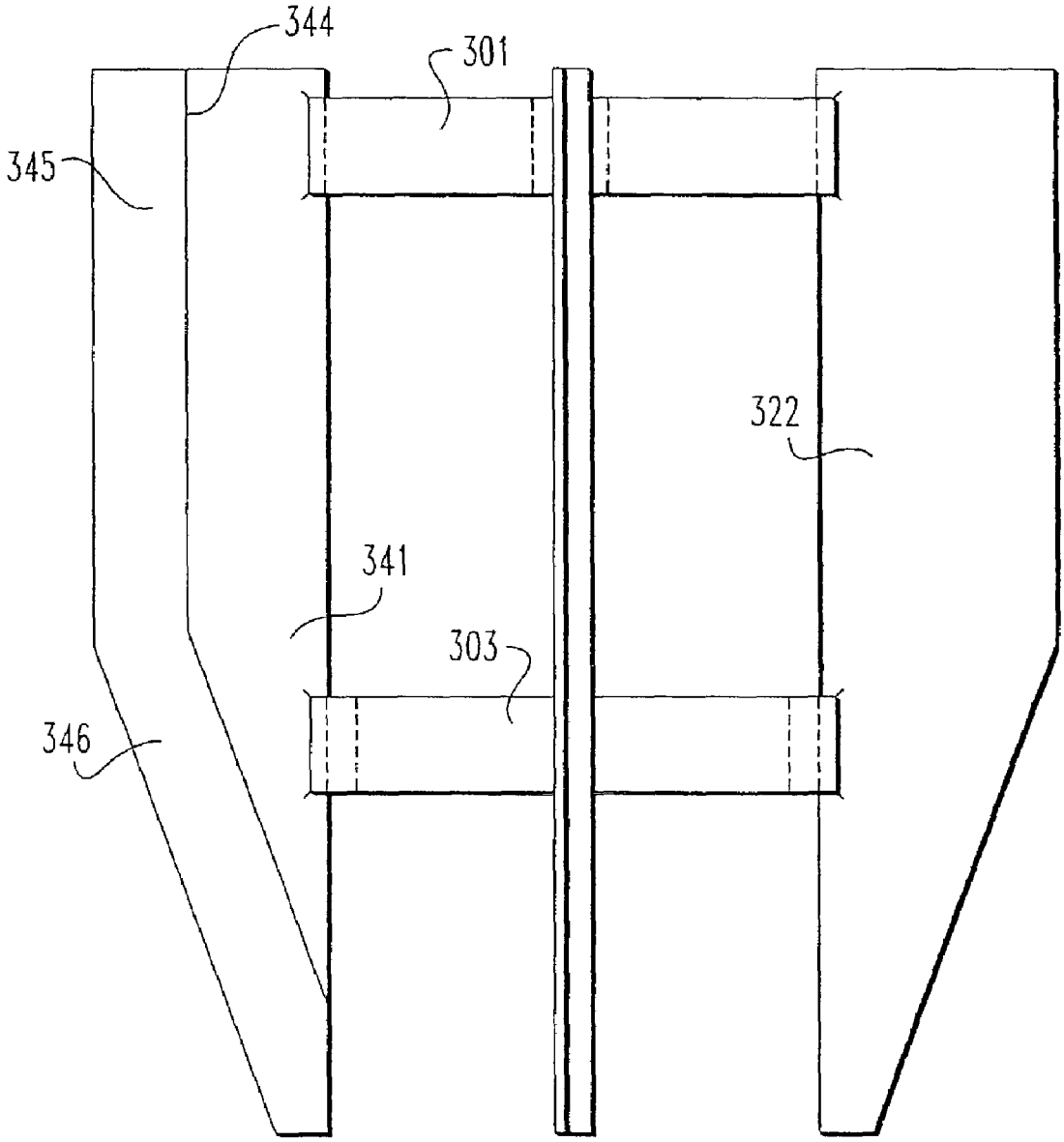
FIG. 8E is a side view of the blade assembly with recesses of the present invention in the 8E—8E {4—4} direction of FIG. 8A.
Figure 9A:
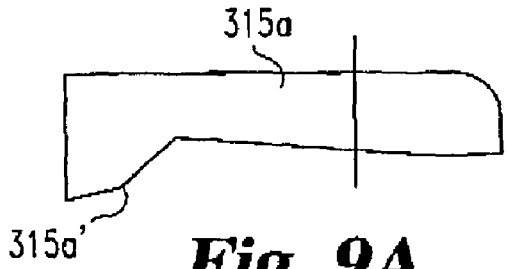
FIGS. 9A–9D are top views of examples of various inserts for placement in the recesses of the blade assembly of FIGS. 8A–8E.
Figure 9B:
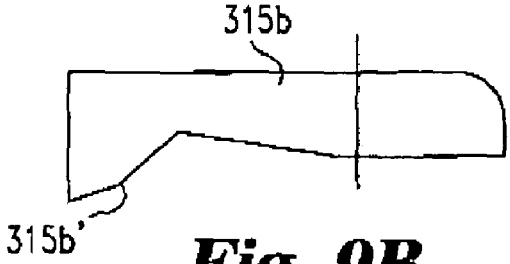
Figure 9C:
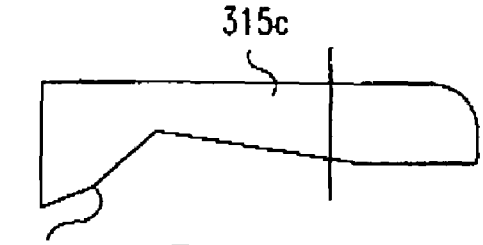
Figure 9D:
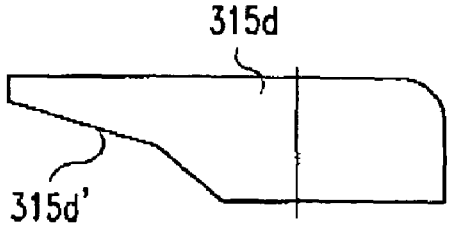

With reference to FIG. 7, an alternative embodiment of the invention is illustrated. In FIG. 7, like objects are labeled as previously. The difference in this embodiment is that instead of having stationary or immovable set of teeth 204, a sprocket 210 is attached to the bottom surface 203 in such a manner that it may rotate. Sprocket 210 is affixed to set of teeth 204 which are sized for interlocking engagement with the set of teeth 164 on the top of shifting coupling 122. Sprocket 210 is driven by chain 211. Motive force is provided to chain 211 by a second motor 212. In operation, this embodiment allows the scraper blades to be driven in a direction opposite that of the bowl during the scraping mode of centrifugal separation. Since the bowl and the blades rotate in opposite directions, the time necessary to effectively scrape the interior of the bowl of solids is correspondingly reduced. Alternatively, the scraper blades may be driven in the same direction as the bowl but at a different speed so that bowl and blades rotate relative to one another, and scraping occurs.

The advantages of this clutch or coupling mechanism are numerous. This clutch mechanism positively locks the scraper blades or stilling vanes with the drive mechanism that drives the bowl. This ensures the same rotational speed for both bowl and blade, and keeps the liquid within the bowl from slipping, resulting in higher efficiencies during operation. This design also allows the centrifuge to be operated with one motor as opposed to two. Even in the embodiment described above with two motors, the second motor need only be run during scraping time. As a result, the design of the present invention is a much less complicated assembly and the change-out time for replacing parts is greatly lowered. For example, the GLASSLINE prior art devices such as DL 75, DL 175, or DL 275 manufactured by GLASSLINE Corporation of Perrysburg, Ohio previously described takes 4–6 hours to change-out by an experienced mechanic familiar with the system. In contrast, in the embodiment described above where set of teeth 204 are stationary, it took less than 30 minutes for the same mechanic to change-out the second time it was done.

Additionally, it will be noted that this clutch assembly has fewer parts than the prior art frictional clutch assembly and requires no lubrication leading to a longer lifetime. Moreover, the design of the clutch assembly of the present invention allows the user to shift on-the-fly reducing scraping time correspondingly. To illustrate the advantages of shifting on the fly, the operation of the centrifuge will be discussed briefly. During processing shifter 144 is shifted downward so that set of teeth 163 on shifting coupling 129 are in interlocking engagement with set of teeth 159 located on either spindle 160 or pulley 143. Thus, pulley 143 is driving both spindle 160 and affixed bowl 185 as well as shaft 161 and affixed scraper blades or stilling vanes 170. When shifting on the fly, shifter 144 is shifted upward so that set of teeth 164 on top of shifting coupling 122 are in interlocking engagement with set of teeth 204 which are stationary and affixed to support structure 199. Thus, stilling vanes 170 are stationary while bowl 185 continues to rotate, and scraping occurs since stilling vanes 170 are moving relative to bowl 185. This is advantageous because when scraper blades 170 rotate to scrape, they can fling the solid out past the receptacle. Because the bowl 185 rotates as opposed to scraper blades 170, the solid falls under the influence of gravity down into a waiting receptacle (not shown).

Furthermore, the present design minimizes the amount of unsupported shaft 161 from approximately seven inches in the prior art devices to on the order of two inches in the present device. Even the two inches in the present invention possess support from the teeth which are affixed to the support assembly in one embodiment. The minimization of the amount of unsupported shaft reduces the possibility for vibration and potentially destructive oscillation. Additionally, this design does not require any parts to be hanging on the unsupported portion of shaft 161.

Centrifugal separation operating in the low to mid range of zero to two thousand g's allows the extraction of solid particles from a contaminated liquid containing a liquid and solid particle in suspension. Motor 207 need only produce 7.5 to 10 hp to operate one embodiment of the centrifuge, in which bowl 185 has a processing volume of 6 gallons, in this range. One motor used is the 10 hp, 3600 max rpm motor manufactured by Lincoln Electric Part No. LM 16243TF6255/1, of Cleveland, Ohio. Different size centrifuges, however, will have different power requirements of motor 207. Another added benefit of this invention is that the reduction in the amount of unsupported shaft 161, as well as the minimization or lack of parts hanging from it, allow the use of larger centrifugal forces in excess of 2000 g's. Filtration of smaller particles is possible with larger centrifugal forces.

Additionally, the use of larger centrifugal forces lowers the residence time for a particular size solid, which is the amount of time the liquid is in the bowl and under centrifugal force so that the solids in the liquid are forced out to the wall. Thus, because of the reduction in residence time available using larger centrifugal forces and the reduction in scraping time available from shifting on the fly, total processing time is reduced. This allows the use of a smaller system to process the same amount of liquid in the same amount of time. As a result, a wide variety of centrifuges and motor sizes are contemplated as within the scope of the invention. Similarly, a correspondingly wide variety of centrifugal forces extending from the zero to two thousand g's previously used to more than two thousand g's as now possible with this invention are contemplated as within the scope of this invention.

With reference to FIGS. 8A–8E and 9A–9D, another aspect of the present invention is illustrated. The solids in suspension in the liquid are often sticky and refuse to let go of the scraper blade. In this situation, different scrapfing edge geometries are often necessary to get the solids to peel off the scraper blade. The scraper blades, howerver, are expensive and must be individually balanced to reduce the potential for destructive oscillation. Illustrated in FIGS. 8A–8E is a scraper blade assembly 300. Blade assembly 300 has blades 310, 320, 330, and 340 which are affixed to plate 301 on their top portiona and which are further affixed to ring 303 on their bottom portion. Plate 301 has an opening 302 in its cener through which the bottom protion of the centrifuge drvie shaft (not shown) passes. Blades 310, 320, 330, and 340 have front faces 311, 321, 331, 341, back faces 312, 322, 332, 342, and ends 313, 323, 333, 343, and recesses 314, 324, 334, and 344, respectively. The recesses 314, 324, 334, and 344 are defined on the front faces 311, 321, 331, 341 adjacent ends 313, 323, 333, 343, respectively. Into recesses 314, 324, 334, 344, different inserts 315 and 316, 325, and 326, 335 and 336, 345 and 346, respectively, are attached by screws or bolts for different applications such as oil, water, acid and other liquids with solids in suspension. The use of recesses with inserts received therein for the blade assembly 300 allows the cutting geometry of blade assembly 300 to be easily customized based on the liquid-solid combination being separated. It is understood that blade assembly 300 may have as few as two or more than four blades.

The base scraper blade assembly 300 is the same for each centrifuge. The base blade assembly 300 may be balanced and the inserts added afterward. As long as the inserts 315 and 335, 316 and 336, 325 and 345, 326 and 346, respectively, have the same mass, the blade assembly 300 will remain balanced. This eliminates the need to rebalance the blade assembly 300 for vibration control. This invention permits the use of easily varied geometries along a single blade cutting edge of blade assembly 300. Even greater efficiencies may be obtained by mixing and matching geometries on the same blade since heavier solids may accrete in different places on the bowl than the lighter solids. For example, the geometry of insert 315 and that of insert 316 and correspondingly the geometry of insert 325 and insert 326 may be varied on one edge to provide the most effective cutting surface for the different solids at different elevations along the longitudinal axis of the bowl.

FIGS. 9A–9D illustrate top views of four examples for cutting surface profiles 315*a'*, 315*b'*, 315*c'*, 315*d* for the inserts 315*a*, 315*b*, 315*c*, 315*d*, respectively. It is understood that other cutting surface profiles are within the scope of the invention.

It is contemplated as within the scope of the invention that if geometry permits, a single insert might be placed within recesses 314, 324, 334, and 344 of blade assembly 300. It is understood that more than two inserts may be placed within any recess 314, 324, 334, and 344 if more than two different cutting edge geometries are necessary. It is also understood that any single insert may be formed to have a varying scraping edge profile along its length. In a preferred embodiment, inserts 315 and 335, inserts 316 and 336, inserts 325 and 345, and inserts 326 and 346, respectively, have not only the same mass, but are also mirror images of one another around the centerline 309 which scraper blade 300 rotates.

This aspect of the invention is useful because it solves the problems previously discussed. Each base scraper blade assembly 300 costs approximately $1500.00 to $2000.00. The use of the same base scraper blade assembly permits the varying of the cutting edge geometry in a much simpler and more economical fashion. Simpler because it is much easier to machine the inserts then the blade assembly, and more economical because it allows the use of the same base scraper blade assembly.

Figure 10:
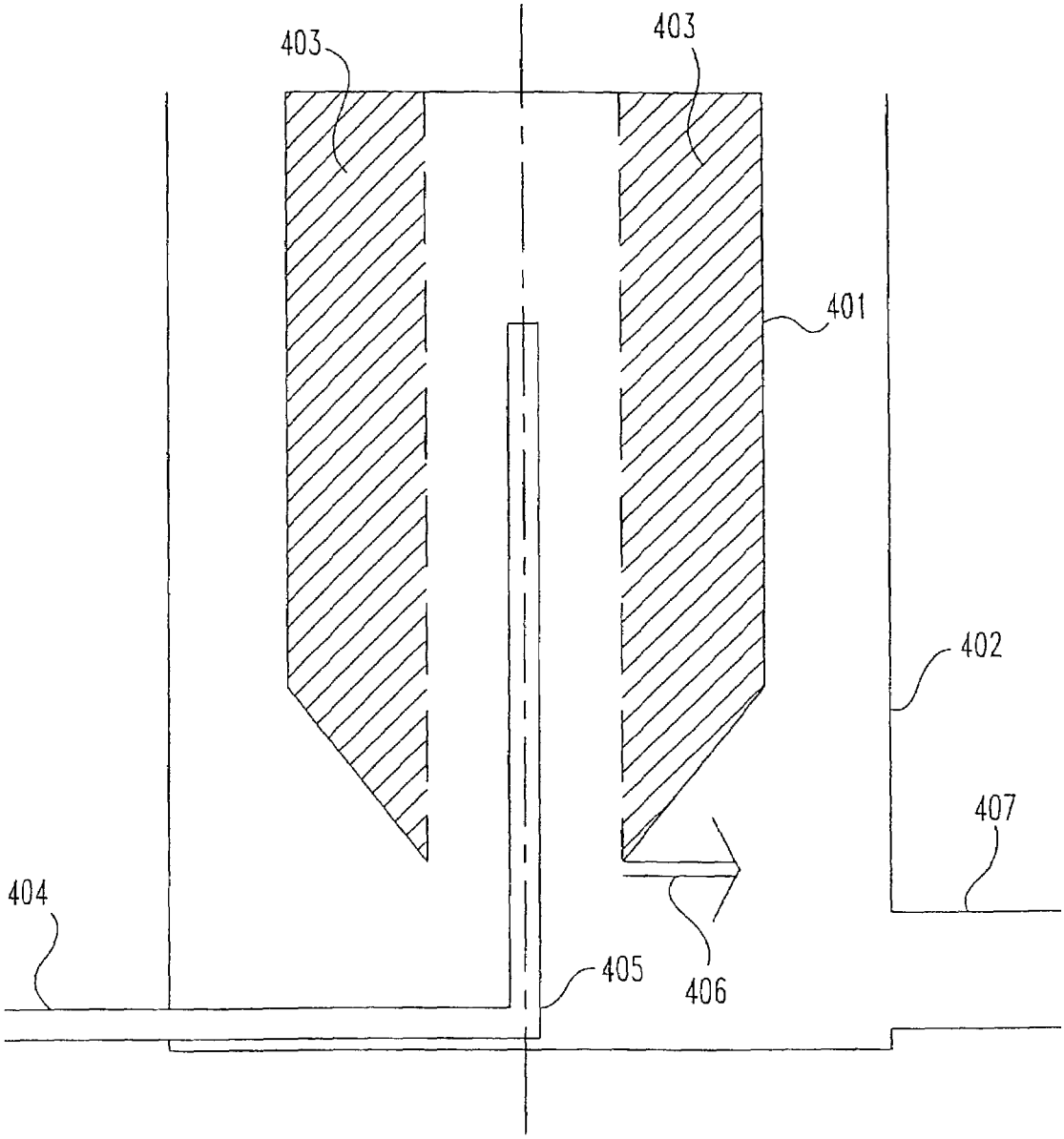
Fig. 10 (PRIOR ART)
FIG. 10 is a side view of the operation and exiting of fluid from within the centrifuge bowl of the prior art.
Figure 11:
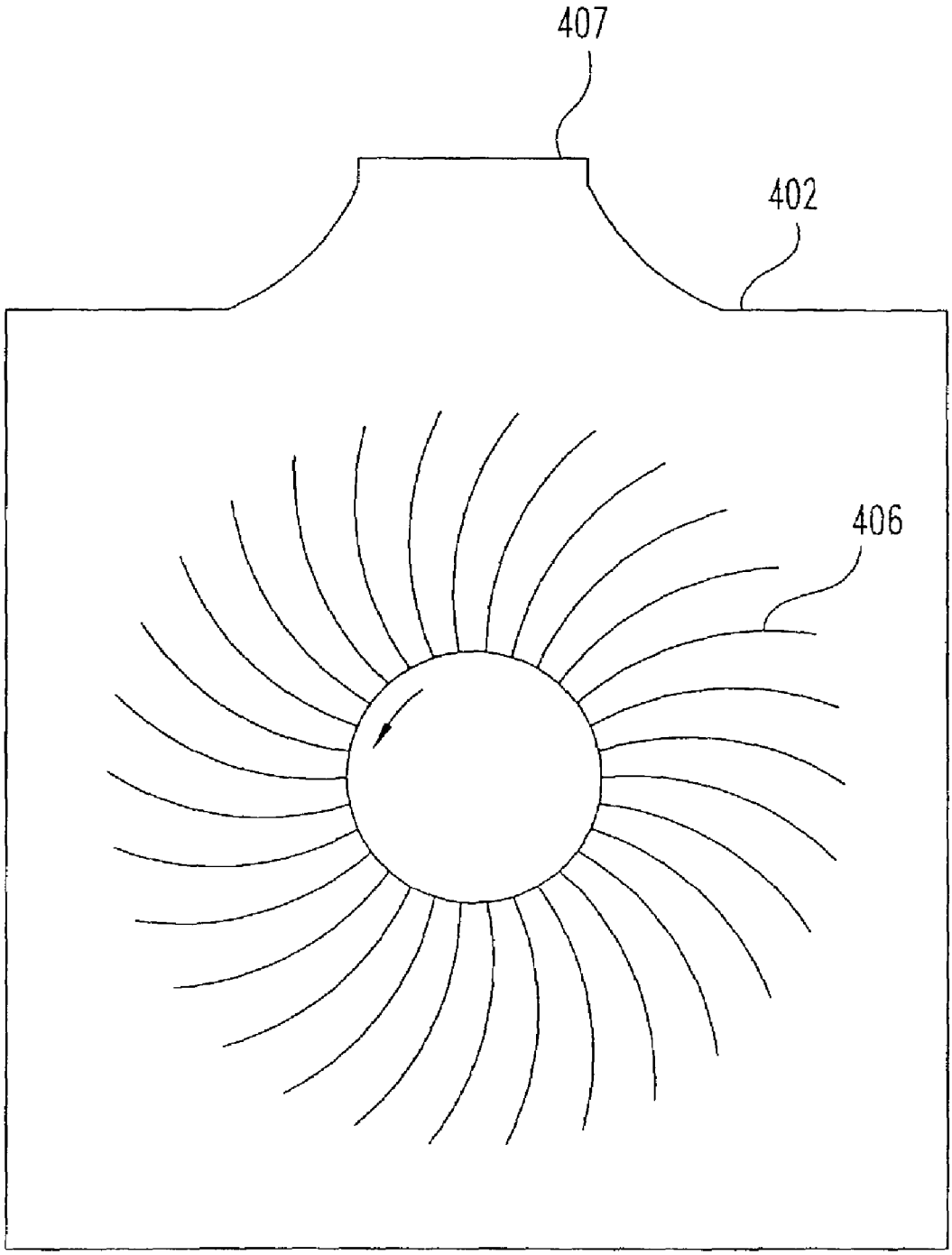
Fig. 11 (PRIOR ART)
FIG. 11 is a top view of the operation of the prior art device of FIG. 10.

With reference to FIGS. 10 and 11, there is illustrated the design by which liquid exits the centrifuge after processing. Contaminated liquid enters the housing 402 through inlet port 404 and is injected upward into the rotating bowl 401 by bottom injector 405. The injected liquid stays within the bowl 401 until the shaded regions (FIG. 10) illustrating the processing volume 403 are full. After processing volume 403 is full continued injection of liquid into bowl 401 results in the overflow of centrifuged liquid at the bottom lip of bowl 401 as indicated by arrow 406 in FIG. 10. Since the bowl is rotating as indicated by the arrow in FIG. 11, the centrifuged liquid has both tangential and radial velocity components. This results in the spray path 406 as illustrated in FIG. 11. The liquid exits the housing 402 through outlet port 407.

Figure 12:
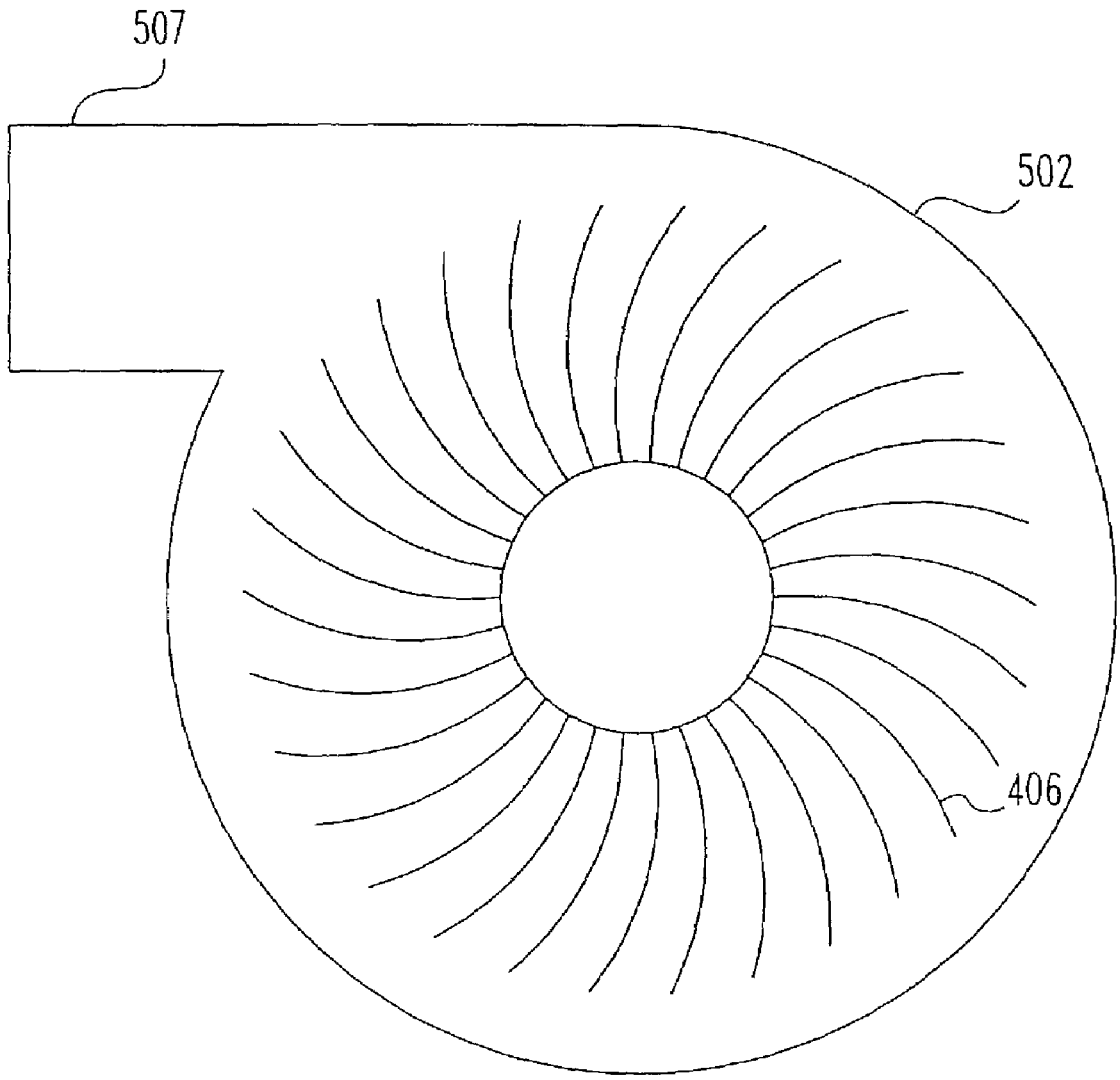
FIG. 12 is a top view of the operation of the fluid exiting the bowl of the present invention.

In the devices of the prior art, housing 402 was square and outlet port 407 was positioned on one side of housing 402. In the improvement of the present invention, as illustrated in FIG. 12, housing 502 is circular and has a tangential outlet port 507. The tangential outlet in this design results in less splash. It is understood that this aspect of the invention may be used with a top feed injector or a top fluid exiting centrifuge or both. The tangential outlet takes advantage of liquid rotation, as opposed to simply falling out under the influence of gravity, it generates an exit velocity. This reduced splash prevents the formation of a mist or spray that could cloud the room and endanger human occupants when toxic materials are being centrifuged. Another advantage of this tangential outlet that has been noted by the inventor is that when liquid is being injected into the system and exiting during processing, its exit through the tangential outlet creates a suction/vacuum. Thus, any misting that occurs does not flow up between the exterior surface of the bowl and the interior surface of the housing. This aids in the prevention of buildup of deposits or crusting on the exterior surface of the bowl and the interior surface of the housing.

While the invention has been illustrated and described in detail in the drawings and foregoing description, the same is to be considered illustrative and not restrictive in character, it being understood that only the preferred embodiment has been shown and described and that all changes and modifications that come within the spirit of the invention are desired to be protected.

What is claimed is:

1. A centrifuge for separating solids from a liquid, comprising:

a spindle configured to rotate about an axis;

a bowl attached to said spindle to rotate therewith, said bowl being configured to receive the liquid containing the solids;

a drive shaft received through a passageway defined by said spindle, said drive shaft being configured to rotate about said axis;

a scraper blade attached to said drive shaft to rotate therewith, said scraper blade being positioned in said bowl to selectively remove the solids accumulated on an interior surface of said bowl; and a clutch mechanism having a first engaging member non-rotatably affixed to said drive shaft, a second engaging member non-rotatably affixed to said spindle, and means for selectively and positively engaging an interlocking surface of said first engaging member directly with an interlocking surface of said second engaging member.

2. The centrifuge of claim 1, further comprising:

a housing receiving said rotatable bowl therein, said housing having a cylindrical portion and a closed top end and at least a partially open bottom end, said housing having an outlet extending tangentially from said cylindrical portion so as to minimize the entrainment of gas by a liquid exiting said bowl when said bowl is rotating.

3. The centrifuge of claim 2, wherein said scraper blade comprises a plurality of stilling vanes.

4. The centrifuge of claim 2, wherein the centrifuge is an inverted bowl automatic self-discharging centrifuge.

5. The centrifuge according to claim 1, further comprising a motor rotatably connected to said spindle to impart rotation thereto upon activation of said motor, wherein said motor is selectively rotatably connected to said shaft by said clutch mechanism.

6. The centrifuge according to claim 1, wherein the means for selectively and positively engaging includes a shift mechanism coupled to said first engaging member for axially displacing said first engaging member into interlocking engagement with said second engaging member.

7. The centrifuge according to claim 1, further comprising a third engaging member mounted on a surface of a support structure of the centrifuge wherein said means for selectively and positively engaging further includes means for alternatively selectively and positively engaging a second interlocking surface of the first engaging member with an interlocking surface of said third engaging member.

8. A centrifuge for separating solids from a liquid, comprising:

a spindle configured to rotate about an axis;

a bowl attached to said spindle to rotate therewith, said bowl being configured to receive the liquid containing the solids;

a drive shaft received through a passageway defined by said spindle, said drive shaft being configured to rotate about said axis;

a scraper blade attached to said drive shaft to rotate therewith, said scraper blade being positioned in said bowl to selectively remove the solids accumulated on an interior surface of said bowl; and means for selectively engaging and disengaging an engaging surface of a first engaging member non-rotatably affixed to said drive shaft directly with an engaging surface of a second engaging member non-rotatably affixed to said spindle to permit said drive shaft and said spindle to rotate in tandem when engaged or independently when disengaged.

9. The centrifuge according to claim 8, wherein the means for selectively engaging and disengaging includes a shift mechanism coupled to said first engaging member for axially displacing said first engaging member into and out of interlocking engagement with said second engaging member.

10. The centrifuge according to claim 8, further comprising a third engaging member mounted on a surface of a support structure of the centrifuge wherein said means for selectively engaging and disengaging further includes means for alternatively selectively disengaging and engaging said first engaging member with said third engaging member.

11. A centrifuge for separating solids from a liquid, comprising:

a rotatable bowl assembly, rotatable about an axis and having a first engaging member non-rotatably affixed thereto;

a scraper blade assembly positioned to rotate in said bowl assembly on the same axis as said bowl assembly and having a second engaging member non-rotatably affixed thereto;

a coupling mechanism for selectively interlocking an engaging surface of said first engaging member directly with an engaging surface of said second engaging member; and a single drive motor rotatably connected to said rotatable bowl assembly to impart rotation thereto upon activation of said motor, wherein said motor is selectively rotatably connected to said scraper blade assembly by said coupling mechanism.

12. The centrifuge according to claim 11, further comprising a third engaging member wherein said coupling mechanism further includes means for alternatively selectively disengaging and engaging said second engaging member with said third engaging member.

13. The centrifuge according to claim 11, wherein:

said rotatable bowl assembly comprises a spindle and a bowl attached to said spindle to rotate therewith such tat said first engaging member is affixed to said spindle; and said scraper blade assembly comprises a drive shaft and a scraper blade attached to said drive shaft to rotate therewith such that said second engaging member is affixed to said drive shaft.

14. A centrifuge for separating solids from a liquid, comprising:

a rotatable bowl assembly, rotatable about an axis;

a scraper blade assembly positioned to rotate in said bowl assembly on the same axis as said bowl assembly and having a first engaging member non-rotatably affixed thereto;

a second engaging member mounted on a surface of a support structure of said centrifuge;

a coupling mechanism for selectively engaging an interlocking surface of said first engaging member directly with an interlocking surface of said second engaging member; and a single drive motor rotatably connected to said rotatable bowl assembly to impart rotation thereto upon activation of said motor.

15. The centrifuge according to claim 14, further comprising a third engaging member nonrotatably affixed to said rotatable bowl assembly wherein said coupling mechanism further includes means for alternatively selectively disengaging and engaging said first engaging member with said third engaging member.

16. The centrifuge according to claim 14, wherein:

said scraper blade assembly comprises a drive shaft and a scraper blade attached to said drive shaft to rotate therewith such that said first engaging member is affixed to said drive shaft.

17. The centrifuge according to claim 16, wherein said rotatable bowl assembly comprises a spindle and a bowl attached to said spindle to rotate therewith, and further comprising a third engaging member affixed to said spindle, wherein said coupling mechanism further includes means for alternatively selectively disengaging and engaging said first engaging member with said third engaging member.

* * * * *